US007907882B2

(12) United States Patent
Hara

(10) Patent No.: US 7,907,882 B2
(45) Date of Patent: Mar. 15, 2011

(54) IMAGE HEATING APPARATUS

(75) Inventor: Nobuaki Hara, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 12/620,145

(22) Filed: Nov. 17, 2009

(65) Prior Publication Data

US 2010/0129124 A1 May 27, 2010

(30) Foreign Application Priority Data

Nov. 20, 2008 (JP) ..... 2008-296462

(51) Int. Cl.
*G03G 15/20* (2006.01)

(52) U.S. Cl. ..... 399/329; 399/122

(58) Field of Classification Search ..... 399/107, 399/110, 122, 320, 328–334; 219/216, 619
See application file for complete search history.

(56) References Cited

U.S. PATENT DOCUMENTS

| | | | | |
|---|---|---|---|---|
| 5,666,627 | A | 9/1997 | Yamaguchi | |
| 6,757,513 | B2 * | 6/2004 | Terada et al. | 399/328 |
| 6,849,838 | B2 | 2/2005 | Shimizu et al. | |
| 6,872,925 | B2 * | 3/2005 | Asakura et al. | 219/619 |
| 6,888,113 | B2 | 5/2005 | Monda et al. | |
| 6,901,235 | B2 | 5/2005 | Shimizu et al. | |
| 6,954,608 | B2 * | 10/2005 | Sekiguchi et al. | 399/334 |
| 7,106,999 | B2 * | 9/2006 | Takahashi | 399/328 |
| 7,700,896 | B2 * | 4/2010 | Watanabe et al. | 219/216 |
| 2010/0054786 | A1 | 3/2010 | Hara | |

FOREIGN PATENT DOCUMENTS

| | | |
|---|---|---|
| JP | 7-295414 | 11/1995 |
| JP | 8-76620 | 3/1996 |
| JP | 2002-006659 | 1/2002 |
| JP | 2004-157513 | 6/2004 |
| JP | 2004-341164 | 12/2004 |

* cited by examiner

*Primary Examiner* — Hoan Tran

(74) *Attorney, Agent, or Firm* — Fitzpatrick, Cella, Harper & Scinto

(57) ABSTRACT

An image heating apparatus includes a coil for generating magnetic flux; a rotatable heat generating member, having an electroconductive layer which generates heat by the magnetic flux, for heating an image on a recording material, wherein the coil has a length longer than that of the heat generating member with respect to a rotational axis direction of the heat generating member; and a magnetic member, provided oppositely to the coil at an end position of the heat generating member, having AC magnetic permeability of 1000 or more at 100 kHz.

7 Claims, 12 Drawing Sheets

IMAGE HEATING APPARATUS

FIELD OF THE INVENTION AND RELATED ART

The present invention relates to an image heating apparatus of an electromagnetic (magnetic) induction heating type suitably used as an image heating fixing apparatus (device) to be mounted in an image forming apparatus, such as a copying machine, a printer, or a facsimile machine, for effecting image formation through an electrophotographic system, an electrostatic recording system, a magnetic recording system, or the like.

As the image heating apparatus, it is possible to use a fixing device for fixing or temporarily fixing an unfixed image on a recording material, a glossiness-enhancing device for enhancing glossiness of an image fixed on the recording material by heating the image, and the like device.

In the image forming apparatus, a fixing device is provided in order to fix an unfixed toner image formed on the recording material as a fixed image. As the fixing device, in recent years, those of the electromagnetic induction heating type in which a heating medium such as a heating roller is heated by Joule heat generated by the action of electromagnetic induction have received attention from the viewpoint of energy saving.

Particularly, in a constitution in which a heating belt having an endless shape is used as the heating medium, the heating belt has a thermal capacity smaller than that of the heating roller, so that a rise in temperature is rapid and therefore electric energy consumption can be further reduced.

For example, Japanese Laid-Open Patent Application (JP-A) Hei 08-076620 discloses a heating device of the electromagnetic induction heating type in which a magnetic field is applied to an endless belt-like electroconductive heat generating member by a magnetic field generating means and a material to be heated which is brought into intimate contact with the belt is heated by heat generated by eddy current generated in an electroconductive heat generating layer. The magnetic field generating means is formed integrally with a means for urging the belt to form a nip and is disposed inside the endless belt.

JP-A Hei 07-295414 discloses a fixing device in which the magnetic field generating means is disposed along an outer peripheral surface of a fixing member (heat generating member), so that an induction (exciting) coil as the magnetic field generating means is liable to dissipate heat.

In the fixing device in which the magnetic field generating means is disposed along the outer peripheral surface of the fixing member, as described in JP-A 2004-341164, a length of the coil with respect to its longitudinal direction is shorter than that of the fixing member.

On the other hand, in order to downsize the image forming apparatus, it is preferable that the longitudinal direction length of the fixing member is decreased. As a result, a distance between an end of an image area and an end portion of the fixing member is decreased. For this reason, in order to ensure a temperature at an end portion of the image area, there is need to provide the coil with the longitudinal direction length equal to or longer than the longitudinal direction length of the fixing member.

However, in such a constitution, magnetic flux concentrates at the end portion of the fixing member correspondingly to the increment of the longitudinal direction length of the coil, so that the temperature of the fixing member at its end portion is increased.

SUMMARY OF THE INVENTION

A principal object of the present invention is to provide an image heating apparatus capable of reducing a degree of temperature rise caused to magnetic flux concentration at a metal belt end portion.

According to an aspect of the present invention, there is provided an image heating apparatus comprising:

a coil for generating magnetic flux;

a rotatable heat generating member, having an electroconductive layer which generates heat by the magnetic flux, for heating an image on a recording material, wherein the coil has a length longer than that of the heat generating member with respect to a rotational axis direction of the heat generating member; and a magnetic member, provided oppositely to the coil at an end position of the heat generating member, having AC magnetic permeability of 1000 or more at 100 kHz.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinbelow, the present invention will be described specifically based on embodiments with reference to the drawings. In the present invention, the following embodiments are preferred embodiments of the present invention but the present invention is not limited to constitutions described in the following embodiments. That is, within the scope of the present invention, the constitution described in the following embodiments are substitutable by other known constitutions.

Embodiment 1

(1) Image Forming Station

Figure 2:
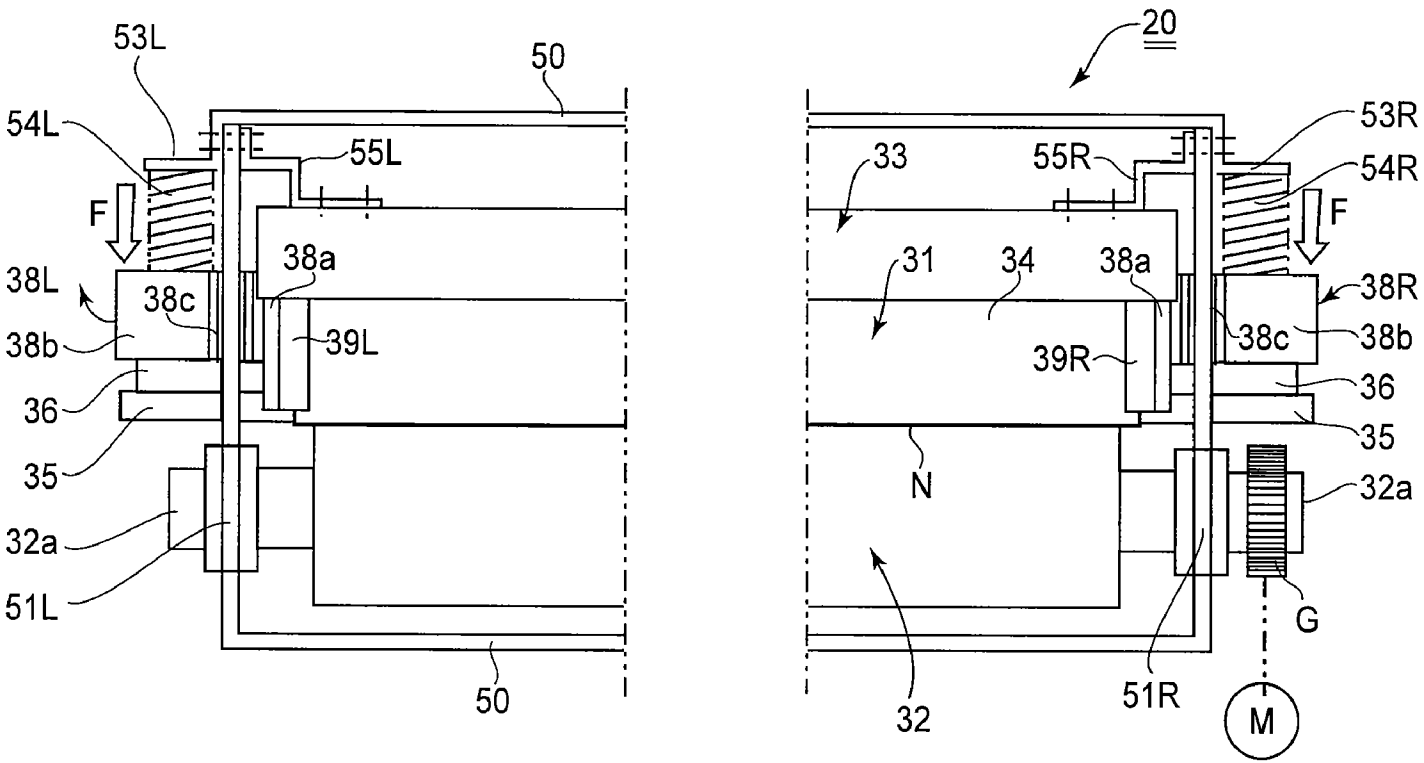
FIG. 2 is a partly omitted schematic front view of the fixing device.

FIG. 2 is a longitudinal schematic view showing a general structure of an electrophotographic full-color printer as an example of an image forming apparatus in which the image heating apparatus according to the present invention is mounted as a fixing device. First, a schematic structure of an image forming station (portion) will be described.

This printer performs an image forming operation depending on image information inputted from an external host device 200 communicatably connected with a control circuit portion (control board: CPU) 100 including a control portion, thus being capable of forming a full-color image on a recording material P and then outputting the full-color image.

The external host device 200 is a computer, an image reader, or the like. The control circuit portion 100 as the control portion sends signals to and receives signals from the external host device 200. Further, the control circuit portion 100 sends signals to and receives signals from various devices for image formation to manage image forming sequence control.

An endless and flexible intermediary transfer belt 8 (hereinafter referred also simply to as a belt) is stretched between a secondary transfer opposite roller 9 and a tension roller 10 and is rotatable driven at a predetermined speed in a counterclockwise direction indicated by an arrow By rotation of the roller 9. A secondary transfer roller 11 presses the belt 8 against the secondary transfer opposite roller 9. A (press)-contact portion between the belt 8 and the secondary transfer roller 11 constitutes a secondary transfer portion.

First to fourth (four) image forming stations 1Y, 1M, 1C and 1Bk are disposed in line under the belt 8 along a belt movement direction with a predetermined interval. Each of the image forming stations is an electrophotographic process mechanism of a laser exposure type and includes a drum-type electrophotographic photosensitive member 2 (hereinafter simply referred to as a drum) as an image bearing member to be rotationally driven at a predetermined speed in a clockwise direction indicated by an arrow. Around the drum 2, a primary charger 3, a developing device 4, a transfer roller 5 as a transfer means, and a drum cleaning device 6 are disposed. The transfer roller 5 is disposed inside the intermediary transfer belt 8 and presses the lower-side belt portion of the belt 8 against the drum 2. A (press)-contact portion between the drum 2 and the belt 8 constitutes a primary transfer portion. A laser exposure device 7 for each of the drums 2 of the respective image forming stations is constituted by a laser emitting means for emitting light correspondingly to a time-serial electric digital pixel signal of image information to be provided, a polygonal mirror, a reflection mirror, and the like.

The control circuit portion 100 causes each image forming station to perform an image forming operation on the basis of a color-separated image signal inputted from the external host device 200. As a result, at the first to fourth image forming stations 1Y, 1M, 1C and 1Bk, color toner images of yellow, cyan, magenta, and black are formed, respectively, on surfaces of associated rotating drums 2. Electrophotographic image forming principle and process for forming a toner image on the drum 2 are well known in the art, thus being omitted from description.

The toner images formed on the drums 2 at the respective image forming stations are successively transferred onto an outer surface of the belt 8, in a superposition manner, which is rotationally driven in the same direction as the rotational directions of the respective drums 2 at a speed corresponding to the rotational speeds of the respective drums 2. As a result, on the surface of the belt 8, unfixed full-color toner images are synthetically formed in a superposition manner of the above-described four toner images.

With predetermined sheet feeding timing, a sheet-feeding roller 14 at a stage selected from a vertical multi-stage sheet-feeding cassettes 13A, 13B, and 13C in which various recording material P having different widths are stacked and accommodated is driven. As a result, one sheet of the recording material P stacked and accommodated in the sheet-feeding cassette at the selected stage is separated and fed to be conveyed to registration rollers 16 through a vertical conveying path 15. When a manual sheet feeding mode is selected, a sheet-feeding roller 18 is driven. As a result, one sheet of the recording material placed and set on a manual sheet feeding tray (multi-purpose tray) 17 is separated and fed to be conveyed to the registration rollers 16 through the vertical conveying path 15.

The registration rollers 16 timing-convey the member P so that a leading end of the recording material P reaches the secondary transfer portion in synchronism with timing when a leading end of the above-described full-color toner images on the rotating belt 8 reaches the secondary transfer portion. As a result, at the secondary transfer portion, the full-color toner images on the belt 8 are secondary-transferred collected onto the surface of the recording material P. The recording material P coming out of the secondary transfer portion is separated from the surface of the belt 8 and guided by a vertical guide 19 into the fixing device 20 as the image heating apparatus. By this fixing device 20, the above-described toner images of a plurality of colors are melted and mixed to be fixed on the surface of the recording material as a fixed image. The recording material coming out of the fixing device 20 is sent onto a sheet discharge tray 23 as a full-color image formed product by sheet discharge rollers 22 through a conveying path 21.

The surface of the intermediary transfer belt 8 after the separation of the recording material at the secondary transfer portion is subjected to removal of residual deposited matter such as secondary transfer residual toner or the like by a belt cleaning device 12 to be cleaned, thus being repeatedly subjected to image formation.

In the case of a monochromatic print mode, only the four image forming station 1Bk for forming the black toner image is actuated. In the case where a both-side print mode is selected, a recording material which has been subjected to printing on a first surface is sent onto the sheet discharge tray 23 by the sheet discharge rollers 22. Immediately before a trailing end of the recording material passes through the sheet discharge rollers 22, rotation of the sheet discharge rollers 22 is reversed in direction. As a result, the recording material is subjected to switch black to be introduced into a re-conveying path 24. Thus, the recording material is conveyed again to the registration rollers 16 in a reversed state. Thereafter, similarly as in the case of the first surface printing, the recording material is conveyed to the fixing device 20 through the secondary transfer portion, thus being sent onto the sheet discharge try 23 as a both-side image formed product.

(2) Fixing Device 20

In the following description, with respect to the fixing device 20 or members constituting the fixing device, a front surface is a surface at which the fixing device is viewed from a recording material entrance side and a rear surface is a surface (recording material exit side) opposite from the front surface. Left and right are those in the case where the fixing device is viewed from the recording material entrance side. Further, the longitudinal direction is a rotational axis direction of the rotatable heat generating member generated by heat generating magnetic flux or a direction parallel to the direction. A short direction is a direction perpendicular to the longitudinal direction. An upstream side and a downstream side are those with respect to a recording material conveying direction. A sheet passing width is a dimension of the recording material with respect to a direction perpendicular to the recording material conveying direction in a plane of the recording material.

Figure 1:
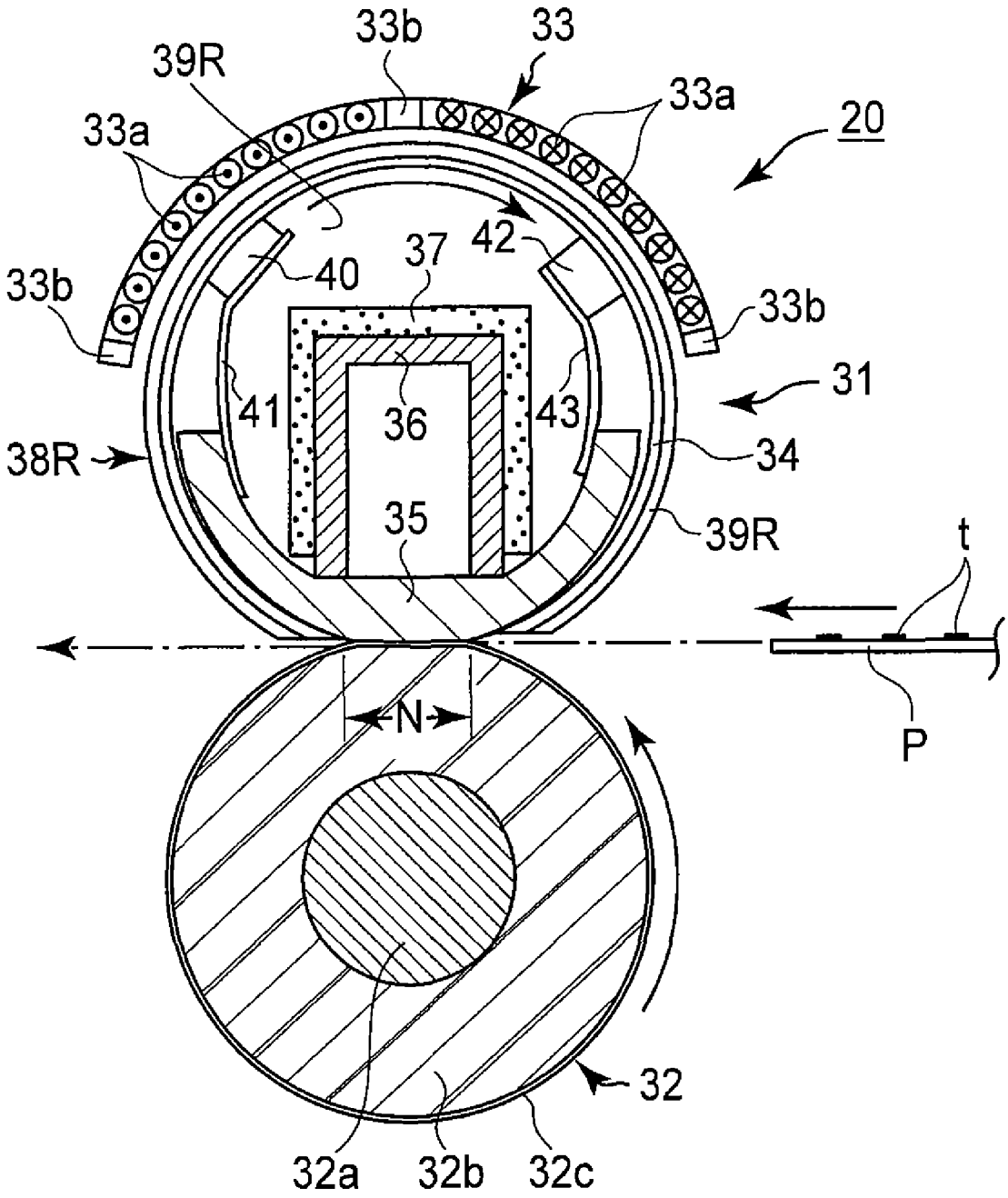
FIG. 1 is a schematic cross-sectional right side view of a principal part of a fixing device in Embodiment 1.
Figure 3:
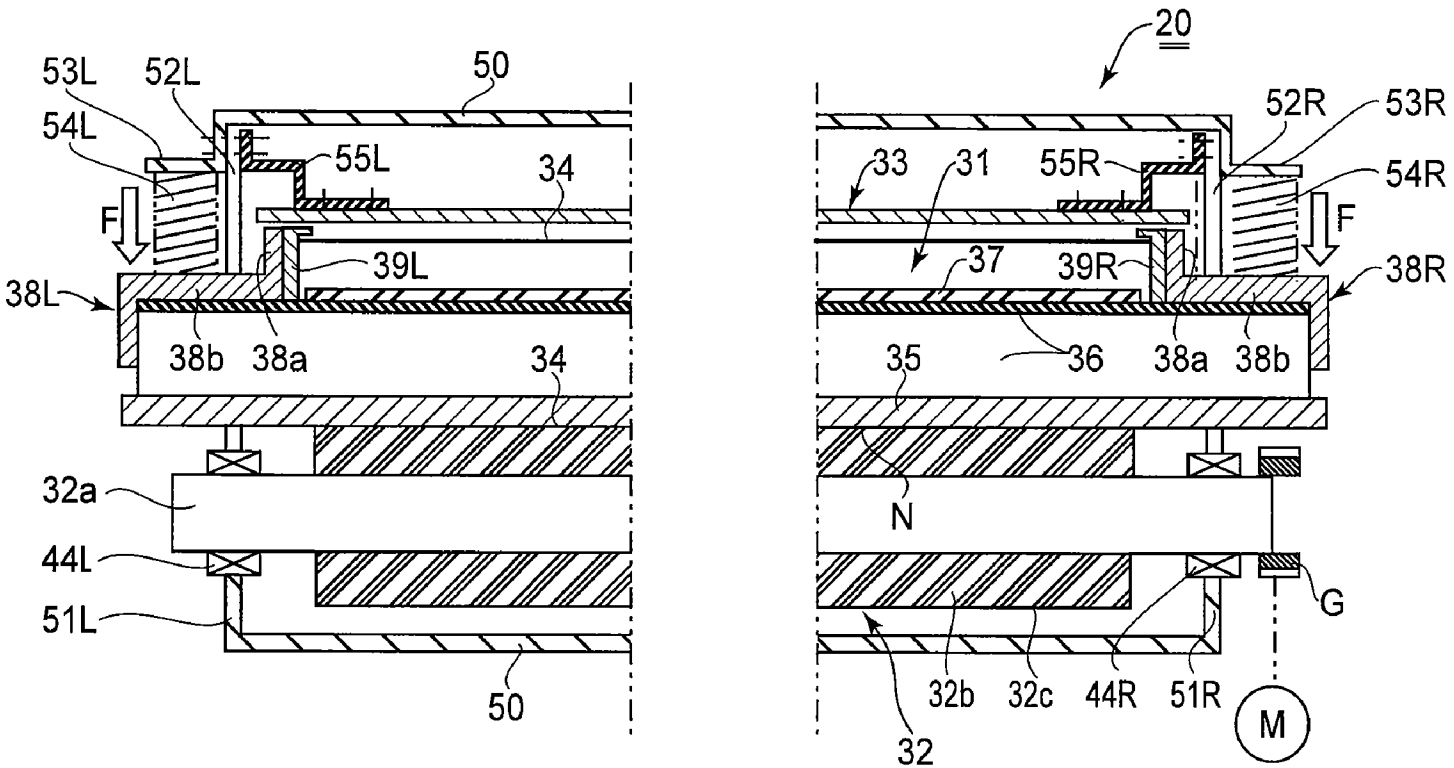
FIG. 3 is a partly omitted schematic longitudinal sectional front view of the fixing device.

The fixing device 20 in this embodiment is the image heating apparatus of the electromagnetic heating type in which the magnetic field generating means is provided outside the fixing member. FIG. 1 is a schematic cross-sectional right side view of a principal port of the fixing device 20. FIG. 2 is a partly omitted schematic front view of the fixing device, and FIG. 3 is a partly omitted schematic longitudinal sectional front view of the fixing device 20.

The fixing device 20 includes a belt assembly 31, as the fixing member, disposed and held between left and right opposite side plates 51L and 51R of a device frame (chassis) 50 at both longitudinal end portions of the belt assembly 31. The fixing device 20 further includes a pressing roller 32, as a rotatable pressing member, disposed and held between the left and right opposite side plates 51L and 51R at both longitudinal end portions of the pressing roller 32. The belt assembly 31 and the pressing roller 32 press-contact each other to form a nip (fixing nip) N, between the pressing roller 32 and a rotatable heat generating member 34 generated by magnetic flux on the belt assembly 31 side, having a predetermined width with respect to a recording material conveying direction. Further, the fixing device 20 includes an exciting coil assembly 33, as the magnetic field generating means, disposed and held between the side plates 51L and 51R on the side 180 degrees opposite from the pressing roller 32 side with respect to the belt assembly 31. The exciting coil assembly 33 is oppositely disposed outside the heat generating member 34 of the belt assembly 31 with a predetermined spacing.

1) Belt Assembly 31

The belt assembly 31 includes the fixing belt 34, as the heat generating member generated by heat through the magnetic flux and configured to heat the image on the recording material by the generated heat, which is cylindrical and has flexibility (flexible endless belt; hereinafter, referred simply to as a belt). The belt 34 has a magnetic portion (electroconductive layer) which generates heat through electromagnetic induction heating when the magnetic portion passes through an area in which a magnetic field (magnetic flux) generated from the coil assembly 33 is present.

The belt assembly 31 includes a belt guide member 35 which is inserted into an disposed inside the belt 34 in a semi-arcuate cross-sectional shape and has heat resistivity and rigidity. The belt assembly 31 also includes a rigid pressing stay 36 inserted into and disposed inside the guide member 35 in an inverted U-like cross-sectional shape. The belt assembly 31 further includes a magnetic core (magnetic shield core disposed inside the belt 34) 37, disposed in an inverted U-like cross-sectional shape so as to cover the outside of the stay 36. Further, the belt assembly 31 includes a left flange member 38L and a right flange member 38R mounted on a left end portion side and a right end portion side, respectively, of the stay 36.

Figure 4:
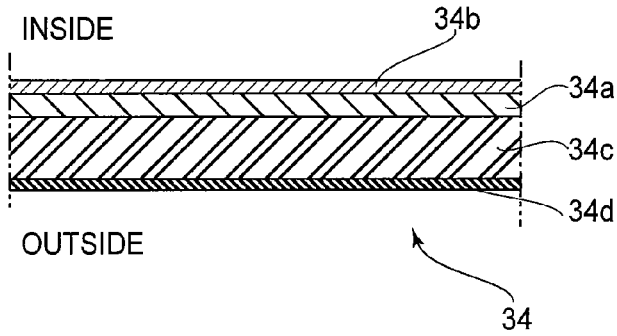
FIG. 4 is a schematic view showing a layer structure of a fixing belt (heat generating member).

FIG. 4 is a schematic view showing a layer structure of the belt 34 in this embodiment. The belt 34 is a member having a four-layer composite layer structure constituting of a cylindrical base layer 34*a*, an inner layer 34*b* provided at an inner peripheral surface of the base layer 34*a*, and an elastic layer 34*c* and a parting layer 34*d* which are successively laminated on an outer peripheral surface of the base layer 34*a*, thus having flexibility as a whole.

The base layer 34*a* is an electroconductive layer of a magnetic member which generate heat through electromagnetic induction heating, i.e., an electromagnetic induction heating layer which generates an induced current (eddy current) by the action of the magnetic field of the coil assembly 33 to generate heat by Joule heat. In this embodiment, as the base layer 34*a*, a 50 μm thick Ni (nickel) electro-formed layer having a diameter of 30 mm is used. The base layer 34*a* may preferably be thin in order to improve a quick start property but requires a certain degree of thickness in consideration of an efficiency of electromagnetic induction heating, so that the base layer 34*a* may preferably have a thickness of approximately 10-100 μm.

The inner surface layer 34*b* is provided to ensure slidability with a member contacting the inner surface of the belt. In this embodiment, a 15 μm-thick polyimide (PI) layer is used as the inner surface layer 34*b*. When the inner surface layer is excessively thick, the inner surface layer adversely affects thermal responsiveness of a temperature detecting means such as a thermistor or the like provided in contact with the inner surface of the belt and adversely affects the quick start property, so that the inner surface layer may preferably have a thickness of approximately 10-100 μm.

The elastic layer 34*c* may preferably have a thickness as small as possible in order to improve the quick start property but requires a certain degree of thickness in order to achieve such an effect that the belt surface is softened to encompass and melt the toner. Therefore, the elastic layer 34*c* may preferably have a thickness of approximately 10-1000 μm. In this embodiment, a 400 μm-thick rubber layer having a rubber hardness (JIS-A) of 10 degrees and a thermal conductivity of 0.8 W/m·K is used.

As the parting layer 34*d*, it is possible to use a PFA tube or a PFA coating. The PFA coating can be decreased in thickness, thus being superior in material to the PFA tube in terms of a large effect of encompassing the toner. On the other hand, the PFA tube is superior to the PFA coating in terms of mechanical and electrical strength, so that it is possible to properly use the PFA tube and the PFA coating depending on the situation. In order to transfer heat to the recording material as much as possible, in either case, the parting layer d may preferably be thinner but may desirably have a thickness of approximately 10-100 μm in consideration of abrasion by the use of the fixing device. In this embodiment, a 30 μm-thick PFA tube is used.

The guide member 35 backs up and rotationally guides the belt 34, and the belt 34 is externally engaged loosely with the guide member 35. As the guide member 35, a heat-resistant resin material can be used and in this embodiment, polyphenylene sulfide (PPS). In this embodiment, the guide member 35 has a thickness of 3 mm.

The stay 36 has the function of pressing the guide member 35 and supporting the magnetic core 37. The stay 36 has the function of suppressing bending of the guide member 35 at the time when the belt assembly 31 and the pressing roller 32 press-contact each other. In this embodiment, the stay 36 is constituted by SUS.

Figure 5:
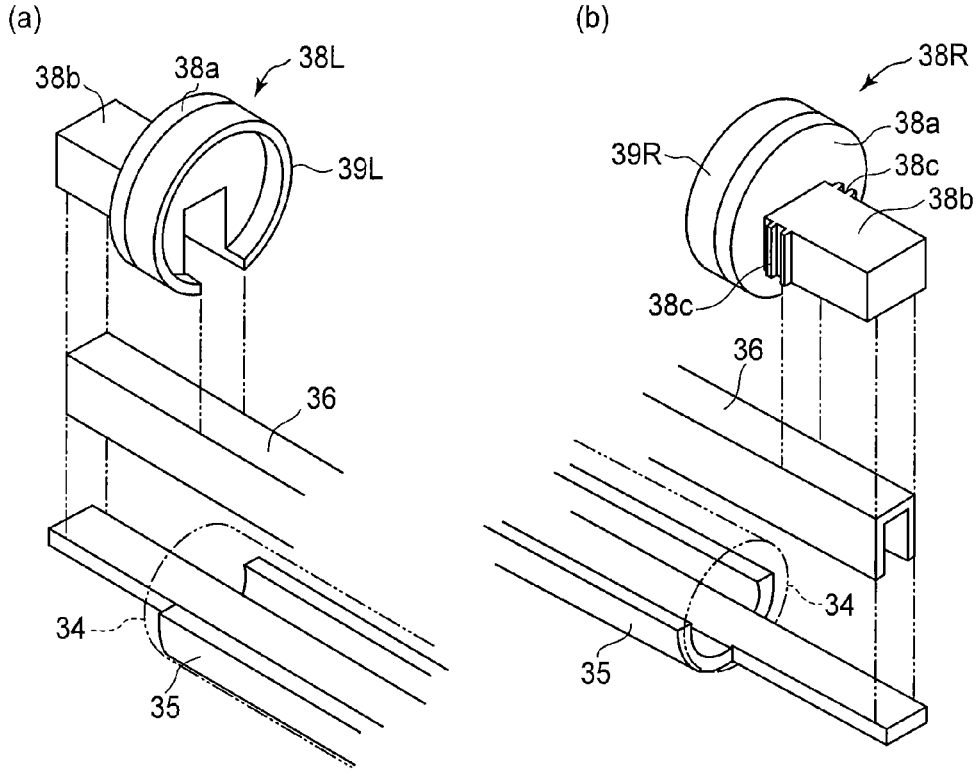
FIG. 5(*a*) is an exploded perspective view showing a left flange member, a left end portion of a stay, and a left end portion of a guiding member, and FIG. 5(*b*) is an exploded perspective view showing a right flange member, a right end portion of the stay, and a right end portion of the guiding member.

The magnetic core 37 is disposed inside the belt 34 and opposes the coil assembly 33 through the belt 34 and adjusts the magnitude of induced magnetic field exerted from the coil assembly 33 to the belt 34. The magnetic core 37 has the function of improving a heat generating efficiency of the belt 34. Further, the magnetic core 37 also has the function of suppressing warming of the stay 36 through the induction heating by covering an outer surface of the stay 36 as the metallic material to block the magnetic flux toward the stay 36. As the magnetic core 37, a material having high magnetic permeability and low loss is used. The magnetic core 37 is used for enhancing an efficiency of a magnetic circuit and for magnetic shielding with respect to the stay 36. As a typical example of the material for the magnetic core 37, ferrite core is used.

left and right flange members 38L and 38R have the function of lateral deviation (movement) toward the left direction or the right direction along the longitudinal portion of the guiding member 35 during the rotation of the belt 34. FIG. 5(*a*) is an exploded perspective view showing the left flange member 38L, the left end portion of the stay 36, and the left end portion of the guiding member 35, and FIG. 5(*b*) is an exploded perspective view showing the right flange member 38R, the right end portion of the stay 36, and the right end portion of the guiding member 35.

Each of the left and right flange members 38L and 38R includes a disk-like flange portion 38*a* facing an associated left (or right) end portion of the belt 34 and includes a pressure-receiving portion 38*b* which covers an associated left (or right) end portion of the stay 36 from above and is fitted on the end portion. Each of the flange members 38L and 38R further includes a vertical guide groove 38*c* provided to front and rear side surfaces of the pressure-receiving portion 38*b*. The left and right flange members 38L and 38R are generally constituted by a high heat-resistant resin material such as PPS (polyphenylene sulfide) or LCP (liquid crystal polymer). In this embodiment, the left and right flange members 38L and 38R are a molded product of PPS. To inner surfaces of the flange portions 38*a* of the flange members 38L and 38R, magnetic members 39L and 39R which are formed of a magnetic material and also function as a belt end portion abutting member for preventing lateral deviation with respect to the longitudinal direction of the belt 34 by receiving the end portion of the belt 34 are attached. The magnetic members 39L and 39R will be described later. The left and right flange members 38L and 38R are engaged, at the guide grooves 38*c*, with vertical guide slit portions 52L and 52R, respectively, provided to the left and right opposite side plates 51L and 51R of the device frame 50. As a result, the left and right flange members 38L and 38R are guided by the guide slit portions 52L and 52R, respectively, thus being disposed slidably (movably) in a direction toward the pressing roller 32 and its opposite direction with respect to the left and right opposite side plates 51L and 51R.

Inside the belt 31, a thermistor 40 as a first temperature detecting means for detecting the belt temperature in order to control the temperature of the belt 34 is disposed. This thermistor 40 is caused to elastically contact the inner surface of the belt 34 at its temperature detecting portion by a spring property of an elastic member 41 while a base portion thereof is held at an end portion of the elastic member 41 fixed to the guide member 35 at the other end. The thermistor 40 is caused to contact a portion which is a belt portion corresponding to the inside of an image forming area and at which an amount of heat generation of the belt 34 by the coil assembly 33 is largest, i.e., a portion at which the amount of heat generation at the inner surface of the belt member 31*a* with respect to the belt rotational direction is largest.

Further, inside the belt 31, a thermo-switch 42 as a second temperature detecting means for detecting the belt temperature is disposed.

This thermo-switch 42 is caused to elastically contact the inner surface of the belt 34 at its temperature detecting portion by a spring property of an elastic member 43 while a base portion thereof is held at an end portion of the elastic member 43 fixed to the guide member 35 at the other end. The thermo-switch 42 is caused to contact a portion at which an amount of heat generation of the belt 34 by the coil assembly 33 is largest, i.e., a portion at which an amount of heat generation at the inner surface of the belt 34 with respect to the belt rotational direction is largest.

2) Pressing Roller 32

The pressing roller 32 as the pressing member is decreased in hardness by providing an elastic layer 32*b* of a silicone rubber or the like to a core metal 31*a*. In order to improve a surface property, at an outer peripheral surface of the pressing roller 32, a fluorine-containing resin material layer 32*c* of PTFE, PFA, FEP, or the like may also be provided as a parting layer.

The pressing roller 32 in this embodiment as an outer diameter of 30.06 mm. The core metal 32*a* has a radius of 8.5 mm and is a solid member of SUS. The elastic layer 32*b* is formed of a silicone rubber in a thickness of 6.5 mm. The parting layer 32*c* is a PFA tube having a thickness of 30 μm.

The pressing roller 32 are rotatably supported and disposed between the left and right opposite side plate, 51L and 51R through bearing members 44L and 44R at both (left and right) end portions of its core metal 32*a*. At the right end of the core metal 32*a*, At the right end of the core metal 32*a*, a drive gear G is fixedly provided.

Between the pressure-receiving portion 38*b* of the left flange member 38L of the belt assembly 31 and a left spring receptor 53L provided to the device frame 50 and between the pressure-receiving portion 38*b* of the right flange member 38R and a right spring receptor 53R, urging springs 54L and 54R are provided, respectively, in a compressed state. A predetermined expansion force F of the left and right urging springs 54L and 54R acts on the guiding member 35 through the pressure-receiving portions 38*b* of the left and right flange members 38L and 38R and through the stay 36. As a result, the guiding member 35 press-contacts the belt 34 to press the pressing roller 32 against elasticity of the elastic layer 32*b*, so that a nip N with a predetermined width with respect to the recording material conveying direction is formed between the belt 34 and the pressing roller 32.

3) Exciting coil assembly 33 c) Exciting Coil Assembly 33

Figure 6:
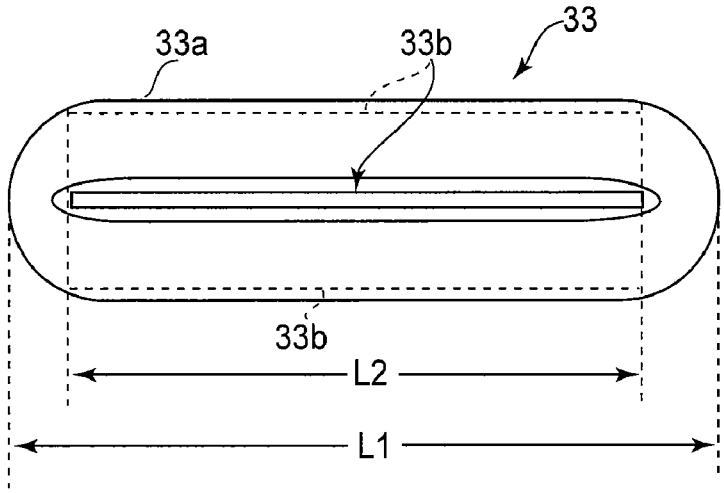
FIG. 6 is a schematic plan view of a coil assembly.

The coil assembly 33 is curved along the outer peripheral surface of the cylindrical belt 34 in a substantially semicircular range in cross section. The coil assembly 33 is disposed in parallel with the belt assembly 31 with respect to their longitudinal directions with a predetermined spacing between its inner surface and the outer surface of the belt 34 on an opposite side from the pressing roller 32 side with respect to the belt assembly 31. The coil assembly 33 is disposed between the left and right opposite side plates 51L and 51R of the device frame 50 through the supporting members 55L and 55R on its left and right sides. FIG. 6 is a schematic plan view of the coil assembly 33. The coil assembly 33 includes the magnetic field generating coil (exciting coil for generating magnetic flux) 33*a* for generating induced current in the base layer 34*a* of the belt 34 and includes a magnetic coil core (magnetic core) 33*b*. The coil 33*a* and the coil core 33*b* are prepared by resin molding or accommodated in a casing (not shown). The coil 33*a* is supplied with high-frequency electric power of 10-2000 kW. As the coil 33*a*, a so-called Litz wire consisting of a plurality of enameled wire strands woven together is used in order to increase a conductor surface area for the purpose of suppressing the temperature rise of the coil. As a coating for the coil 33*a*, a heat-resistant coating is used. The coil core 33*b* is formed of a material having high magnetic permeability and low loss. The coil core 33*b* is used for enhancement of the efficiency of the magnetic circuit and for magnetic shielding. As a typical magnetic core, ferrite core can be used. A necessary property of the core used as such a part of the fixing device is high magnetic permeability. Herein, the high magnetic permeability refers to an AC magnetic permeability of 1000 or more at least at 100 kHz. The AC magnetic permeability of 1000 means that the resultant core has a conducting power for lines of magnetic force 1000 times higher than that of the air layer, thus being suitable for the core material for creating a magnetic path.

4) Fixing Operation

Figure 7:
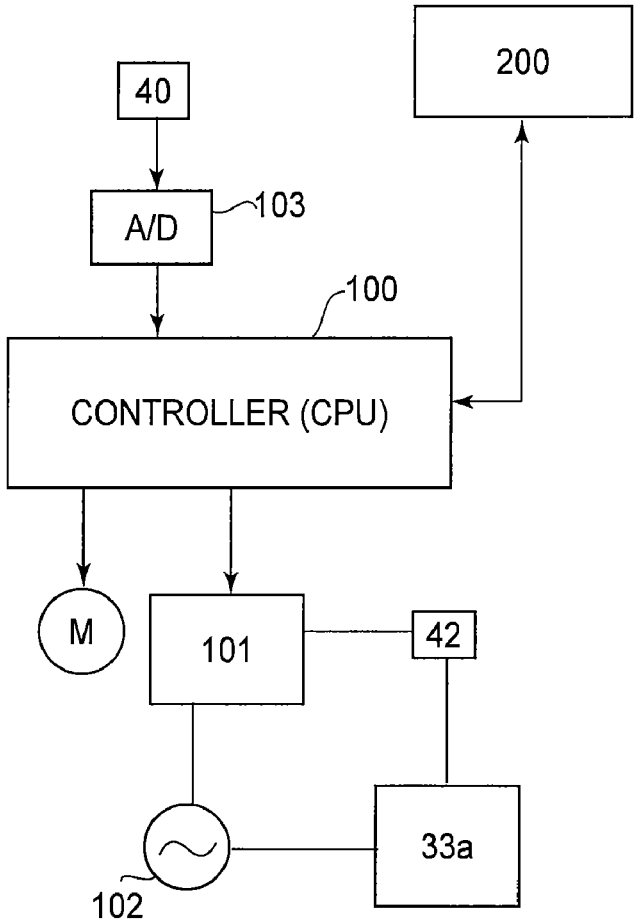
FIG. 7 is a block diagram of a control system.

FIG. 7 is a block diagram of a control system. The control circuit portion 100 drives a fixing device drive motor M with predetermined timing on the basis of an image formation start signal input from the external host device 200. A driving from this motor M is transmitted to the drive gear G through a power transmitting system (not shown), so that the pressing roller 32 is rotationally driven in the counterclockwise direction indicated by the arrow in FIG. 1 at a predetermined speed. By the rotation of the pressing roller 32, a frictional force is generated between the surface of the pressing roller 32 and the surface of the belt 34 in the fixing nip N, thus exerting a rotational force on the belt 34. As a result, the belt 34 is rotated around the outer surface of the guiding member 35 by the pressing roller 32 at the substantially same rotational speed as that of the pressing roller 32 in the counterclockwise direction indicated by the arrow while intimately sliding on the guiding member 35 in the nip at its inner surface.

Further, the control circuit portion 100 turns on an electromagnetic induction heating driving circuit (exciting circuit or high-frequency converter) 101. As a result, the high-frequency current is caused to flow from an AC power source 102 to the coil 33*a* of the coil assembly 33, so that the base layer 34*a* of the belt 34 generates heat through the induction heating by the magnetic field generated by the coil 33*a*. By the heat generation of the base layer 34*a*, the rotating belt 34 is increased in temperature. Then, the temperature of the belt 34 is detected by the thermistor 40, so that electrical information on the detecting temperature is input into the control circuit portion 100 through the A/D converter 103. The control circuit portion 100 controls the electromagnetic induction heating driving circuit 101 so that the belt temperature is increased and kept at a predetermined temperature (fixing temperature) on the basis of the detected temperature information from the thermistor 31*e*. That is, the control circuit portion 100 controls the electric power supply from the AC power source 102 to the coil 33*a*. The thermo-switch 42 is inserted in series into an electric energy supplying circuit for supplying electric energy to the coil 33*a* and is actuated, when the temperature of the belt 34 exceeds a predetermined acceptable temperature, to interrupt the electric power supply to the coil 33*a*.

In the above-described manner, the pressing roller 32 is driven and the belt 34 is temperature-controlled so as to increase in temperature up to the predetermined fixing temperature. Then, in this state, the recording material P having thereon unfixed toner images t is introduced into the fixing nip N with a toner image carrying surface directed toward the belt 34 side. The recording material P intimately contacts the outer peripheral surface of the belt 34 in the fixing nip N and is nip-conveyed through the fixing nip N together with the belt 34. As a result, heat of the belt 34 is applied to the recording material P and the recording material P is subjected to application of the nip pressure, so that the unfixed toner images t are heat-fixed to the surface of the recording material P as a fixed image. The recording material P having passed through the fixing nip N is separated from the outer peripheral surface of the belt 34 to be conveyed to the outside of the fixing device.

5) Fixing Members 39L and 39R

As described above, to the inner surfaces of the flange portions 38*a* of the left and right flange members 38L and 38R, the magnetic members 39L and 39R which are formed of the magnetic material in the cylindrical shape. The magnetic members contains ferrite or iron and has the AC magnetic permeability of 1000 or more at least at the 100 kHz.

The AC magnetic permeability was measured by using a vibrating sample magnetometer ("VSM-5", mfd. by TOEI INDUSTRY CO. LTD.). In this measuring apparatus, a sample placed in a uniform magnetic field is vibrated at a constant frequency of 80 Hz with an amplitude of 0.5 mm and an electromotive force induced in a detection coil disposed in the neighborhood of the sample is detected by using a lock-in amplifier to measure a magnetic property of the sample. In this embodiment, the uniform magnetic field was changed for measurement from zero (Oe) to 3000 (Oe) by 100 (Oe).

In this embodiment, the magnetic members 39L and 39R function as the belt end portion abutting member for preventing the lateral deviation with respect to the longitudinal direction of the belt 34. That is when the belt 34 is moved toward the left side along the longitudinal portion of the guiding member 35 during the rotation of the belt 34, the left magnetic member 39L receives (stops) the side surface of the left side end portion of the belt 34, thus preventing leftward deviation of the belt 34. Further, when the belt 34 is moved toward the right side along the longitudinal portion of the guiding member 35 during the rotation of the belt 34, the right magnetic member 39R receives (stops) the side surface of the right side end portion of the belt 34, thus preventing rightward deviation of the belt 34.

In this embodiment, with respect the rotational axis direction of the belt member, the end portion of the magnetic member is located outside the end portion of the belt member and the magnetic member covers the end portion of the belt member. However, in the present invention, the magnetic member is not necessarily required to completely cover the end portion of the belt member. In the present invention, the end portion of the belt member refers to an area which is other than a sheet passing area of the recording material with a maximum width passable in the direction perpendicular to the recording material conveying direction and is within 20 mm from the end of the belt member. In this area, at least a part of the magnetic member is only required to be located.

Figure 8:
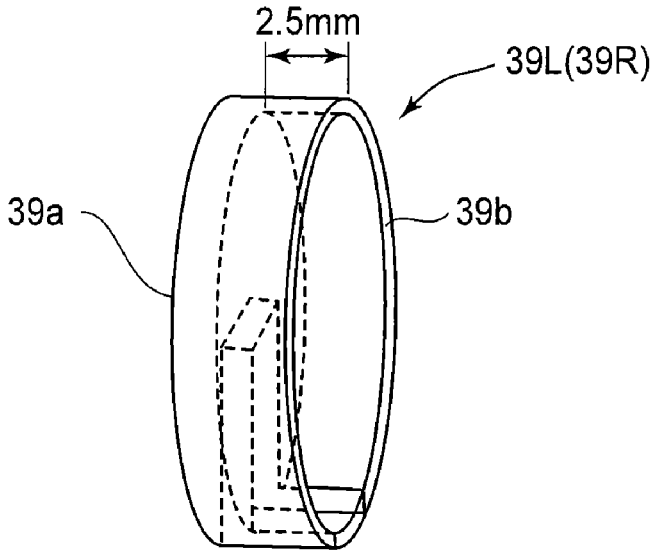
FIG. 8 is a schematic perspective view of a magnetic member.

FIG. 8 is a schematic perspective view of the left and right magnetic members 39L and 39R in this embodiment. Each of the left and right magnetic members 39L and 39R includes a disk-like (cylindrical) portion 39*a* substantially corresponding to the flange portion 38*a* of the associated one of the left and right flange members 38L and 38R and includes an inward projection edge portion 39*b* providing along the outer circumference of the disk-like portion 38*a*. In this embodiment, each of the left and right flange members 38L and 38R themselves was constituted by a 1.5 mm-thick ferrite core. In this embodiment, the ferrite core having the AC magnetic permeability of 1800 at about 100 kHz was used. An amount of projection of the projection edge portion 39*b* is 2.5 mm. The left and right magnetic members 39L and 39R are provided and fixed with an adhesive to the inner side surfaces of the flange portions 38*a* of the left and right flange members 38L and 38R at associated ones of the outer side surfaces thereof. Further, the left end portion of the belt 34 is caused to enter the inside of the projection edge portion 39*b* of the left magnetic member 39L, so that the side surface and the outer peripheral surface of the left end portion of the belt 34 is covered with the left magnetic member 39L. Similarly, the right end portion of the belt 34 is caused to enter the inside of the projection edge portion 39*b* of the right magnetic member 39R, so that the side surface and the outer peripheral surface of the right end portion of the belt 34 is covered with the right magnetic member 39R. In this embodiment, the portions each in the range of 2.5 mm from the end of each of the left and right end portions of the belt 34 are covered with the left and right magnetic members 39L and 39R, respectively. The inner surface of the disk-like portion 39*a* of each of the left and right magnetic members 39L and 39R constitutes an abutting surface with respect to the end portion side surface of the belt 34.

Figure 9:
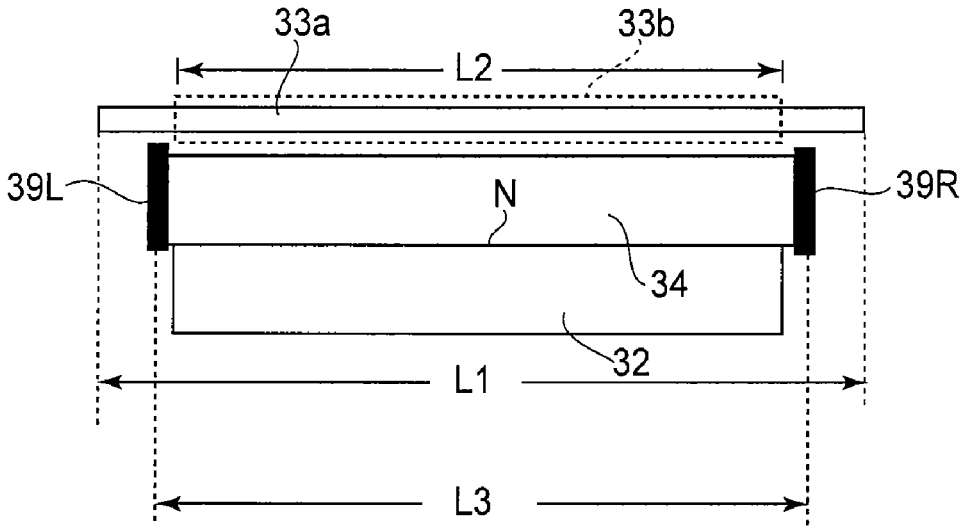
FIG. 9 is a schematic view for illustrating a relationship between a longitudinal direction length of a coil and a longitudinal direction length of a belt.

FIG. 9 is a schematic view showing a length relationship between a longitudinal direction length L1 of the coil 33*a* and a longitudinal direction length L3 of the belt 34. The longitudinal direction is the rotational axis direction of the heat generating member. Further, the longitudinal direction length of the coil is a distance between the both ends of the coil. In this embodiment, L1 is 370 mm and L3 is 340 mm, so that L1>L3 is satisfied, the longitudinal direction length L2 of the coil core 33*b* is 330 mm. The belt 34 was rotated at a speed of 321 mm/s. In this embodiment, L1>L3 is satisfied but a similar effect can also be obtained even in the constitution of L1=L2.

As Comparative Embodiment 1, in the constitution of the fixing device, the magnetic members 39L and 39R as the belt end portion abutting member were changed to non-magnetic members 39L' and 39R' formed of PPS.

As Comparative Embodiment 2, in the constitution of the fixing device, in addition to the constitution of Comparative Embodiment 1, the longitudinal direction length L1 of the coil 33*a* was 370 mm and the longitudinal direction length L3 of the belt 34 was changed to 380 mm, so that L3>L1 was satisfied.

Table 1 shows the constitutes of the fixing devices in Embodiment 1, Comparative Embodiment 1 and Comparative Embodiment 2. Further, a distribution of temperature with respect to the longitudinal direction of the belt 34 in the case where each of the fixing devices in Embodiment 1, Comparative Embodiment 1 and Comparative Embodiment 2 is driven to increase the temperature of the belt 34 at its longitudinal central portion to 190° C. is shown in FIG. 10.

TABLE 1

| EMB. | Relationship | L1(coil) | L3(belt) | Material |
|---|---|---|---|---|
| EMB. 1 | L1 > L3 | 370 mm | 340 mm | Ferrite |
| COMP. EMB. 1 | L1 > L3 | 370 mm | 340 mm | PPS |
| COMP. EMB. 2 | L3 > L1 | 370 mm | 380 mm | PPS |

Figure 10:
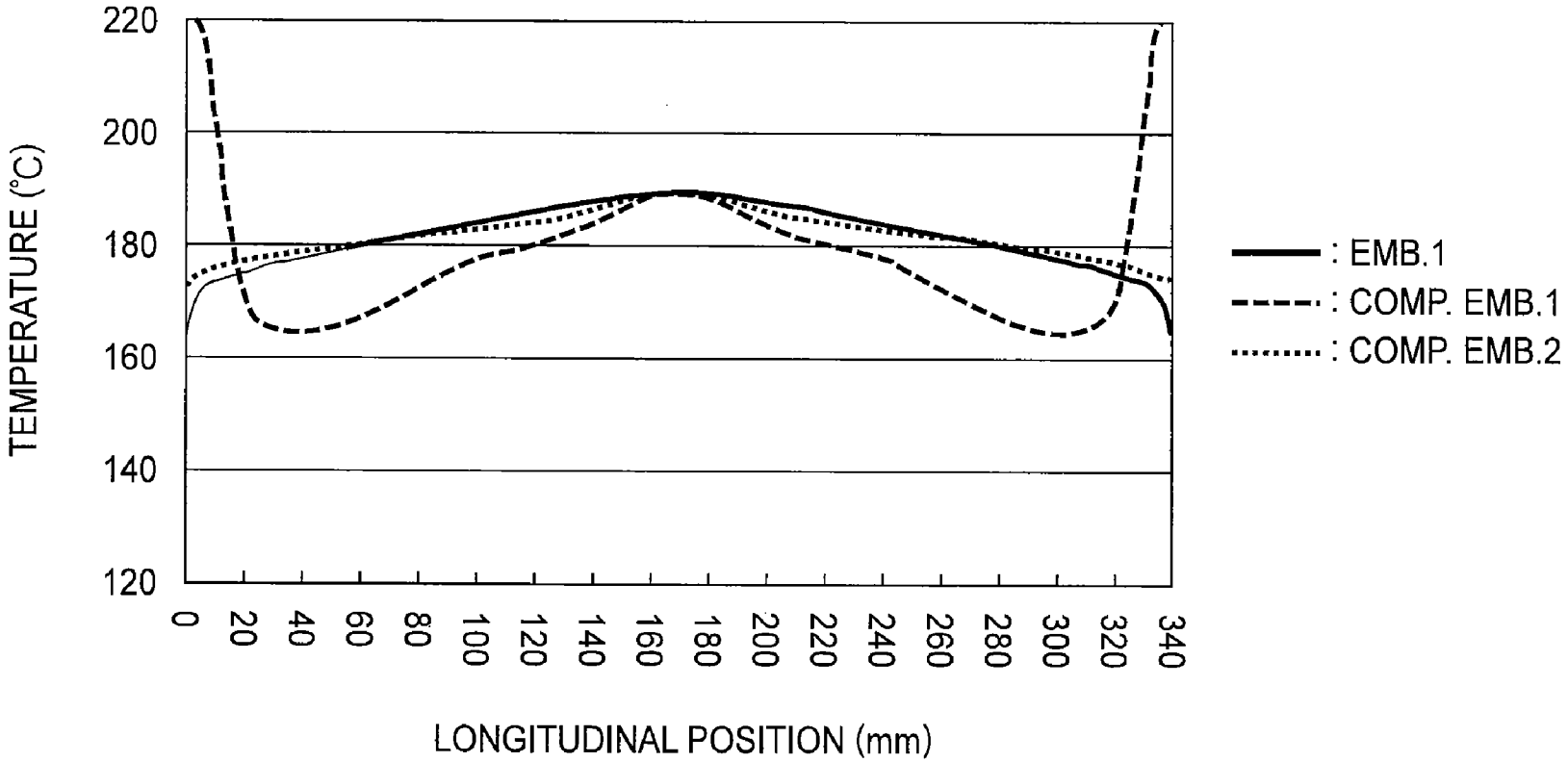
FIG. 10 is a graph showing a distribution of a temperature of the belt along the longitudinal direction of the belt in the case where a longitudinal central portion of the belt is heated from room temperature to 190° C. by driving fixing devices in Embodiment 1, Comparative Embodiment 1, and Comparative Embodiment 2.
Figure 11:
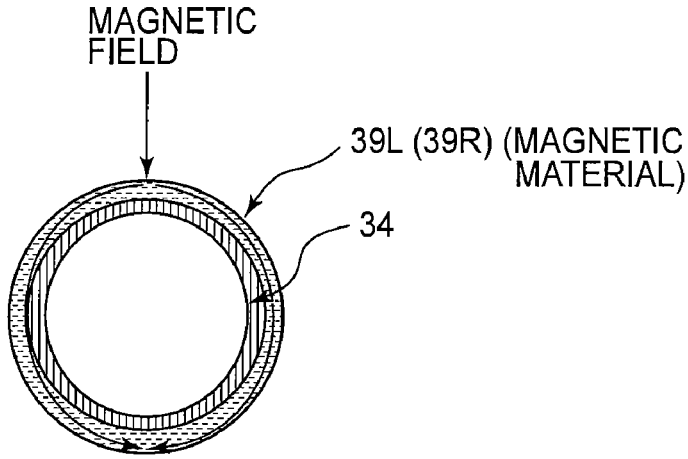
FIG. 11 is a schematic sectional view showing a portion at which the belt end portion is covered with the magnetic member.

In Embodiment 1, as shown in FIG. 11, at the left and right end portions of the belt 34, the magnetic field generated by the coil 33*a* passes through the left and right magnetic members 39L and 39R, so that the temperature rise at the belt end portions is suppressed (FIG. 10). FIG. 11 is a schematic sectional view showing a portion at which the belt end portion is covered with the associated one of the left and right magnetic members 39L and 39R.

Figure 12:
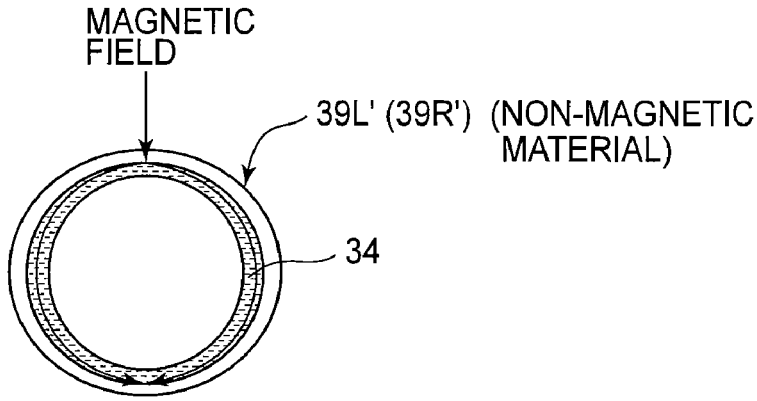
FIG. 12 is a schematic sectional view showing a portion at which the belt end portion is covered with a belt end portion abutting member of a non-magnetic material (PPS) in Comparative Embodiment 1.
Figure 13:
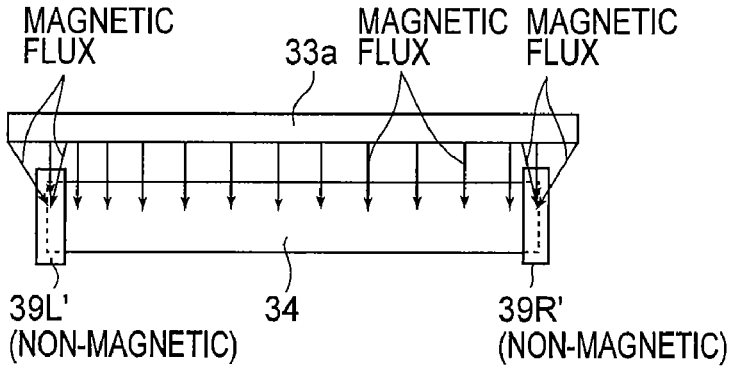
FIG. 13 is a schematic view showing a state of the magnetic flux with respect to the longitudinal direction of the belt in Comparative Embodiment 1.

In Comparative Embodiment 1, the magnetic field generated by the coil 33*a* concentrates particularly at the belt end portions as shown in FIG. 12, so that the temperature at the belt end portions is increased (FIG. 10). FIG. 12 is, similarly as in FIG. 11, a schematic view showing a portion at which the belt end portion is covered with the associated one of the belt end portion abutting members 39L' and 39R' of the non-magnetic material (PPS). A state of the magnetic field with respect to the longitudinal direction of the belt in Comparative Embodiment 1 is shown in FIG. 13, from which it is understood that the magnetic flux concentrates at the belt end portions.

Similarly, also in Embodiment 1, the magnetic flux also concentrates at the belt end portions but the concentrated magnetic flux passes through the magnetic members 39L and 39R formed of the magnetic material as the belt end portion abutting member, so that the temperature rise at the belt end portions is of no problem.

In Embodiment 1 and Comparative Embodiment 2, the uniform temperature distribution with respect to the longitudinal direction is realized in the substantially similar manner. However, compared with Embodiment 1, in Comparative Embodiment 2, the longitudinal direction length L3 of the belt 34 is longer than the longitudinal direction length L1 of the coil 33*a*, so that there is a disadvantage that the fixing device in Comparative Embodiment 2 requires much electric power during the copying due to the increased longitudinal direction length L3.

Figure 14:
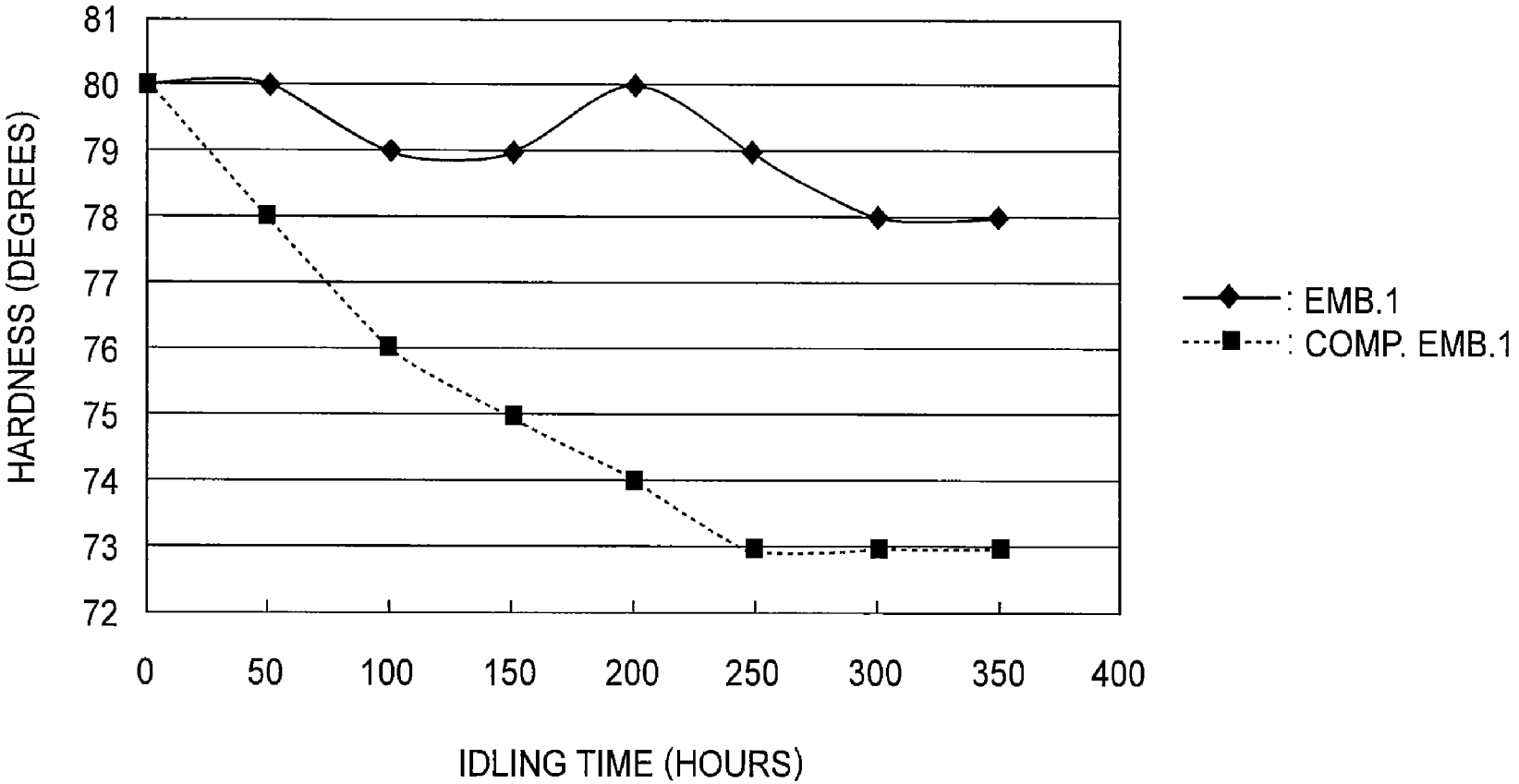
FIG. 14 is a graph showing a change in hardness with the lapse of an idling time in Embodiment 1 and Comparative Embodiment 1.

Further, with respect to Embodiment 1 and Comparative Embodiment 1, when idling of each of the fixing devices in Embodiment 1 and Comparative Embodiment 1 is continued while keeping the temperature of the belt 34 at its longitudinal central portion at 190° C., a hardness of the belt 34 is changed as shown in FIG. 14. From FIG. 14, it is understood that there is a difference in hardness of the belt 34 particularly at the belt end portions between the belts 34 in Embodiment 1 and Comparative Embodiment 1. This may be attributable to thermal deterioration of the elastic layer 34*b* of the belt 34 in Comparative Embodiment 1. Here, the hardness of the belt 34 is a measured value by a micro-rubber hardness meter (trade name: "MD-1 (C type)", mfd. by KOBUNSHI KEIKI CO., LTD.) using a probe of hemisphere type (1 mm in diameter).

As in Embodiment 1, in the case where the positions of the left and right end portions of the belt 34 are regulated by abutting the belt 34 against the abutting members 39L and 39R, it is not preferable that a strength of the belt at its end portions is lowered. The constitution in Embodiment 1 is effective also from the viewpoint of no occurrence of the thermal deterioration at the belt end portions.

That is, when the length of the coil 33*a* is made longer than that of the belt 34 in order to prevent the change in temperature at the end portions of the belt 34, the magnetic flux density is increased at the end portions of the belt 34, thus increasing the belt temperature at the end portions. By preparing the end portion abutting members 39L and 39R for the belt 34 with the magnetic member, the concentration of the magnetic flux at the end portions of the belt 34 is avoided, so that the end portion temperature rise is suppressed and the thermal deterioration at the end portions of the belt 34 is also suppressed.

Thus, the image heating apparatus of the electromagnetic induction heating type in which the magnetic field generating means 33 is provided outside the belt 34 in Embodiment 1 is capable of suppressing excessive temperature rise at the end portions of the heat generating member 34 and the thermal deterioration of the heat generating member 34 while achieving energy saving.

Figure 15:
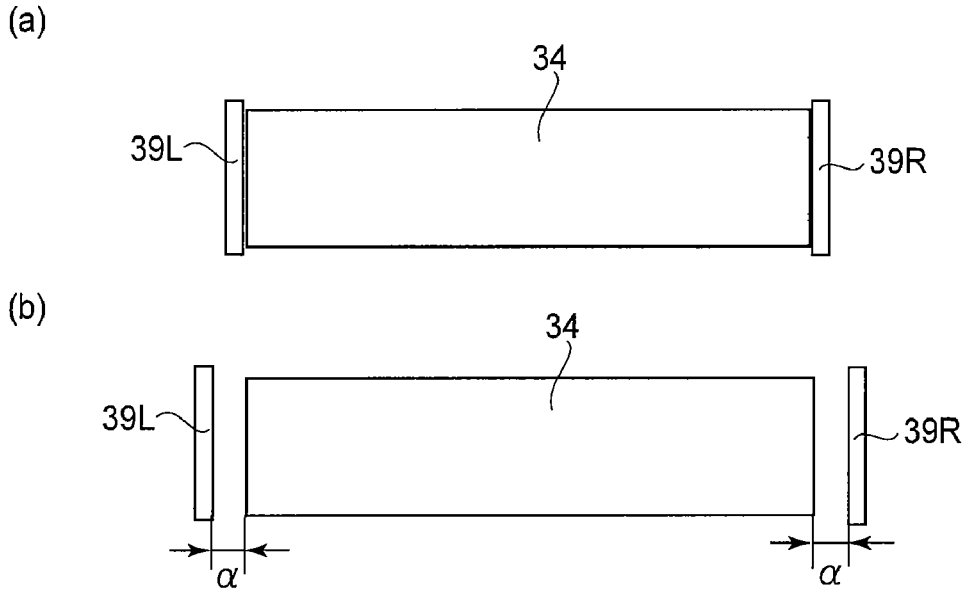
FIG. 15(*a*) is a schematic view showing a constitution in which the magnetic member is disposed in contact with an end portion side surface of the belt, and FIG. 15(*b*) is a schematic view showing a constitution in which the magnetic member is disposed close to the end portion side surface of the belt.

In Embodiment 1, the left and right magnetic members 39L and 39R also function as the belt end portion abutting member. Therefore, the end portion side surfaces and the end portion outer peripheral surfaces of the belt 34 are covered with the magnetic members 39L and 39R. The left and right magnetic members 39L and 39R may also have a constitution in which they are disposed in contact with the end portion side surfaces of the belt 34 without functioning as the belt end portion abutting member as shown in FIG. 15(*a*). Further, as shown in FIG. 15(*b*), the left and right magnetic members 39L and 39R may also have a constitution in which they are disposed close to the belt 34 without contacting the end portion side surfaces of the belt 34. In this case, a distance a between the end portion side surface of the belt 34 and the associated magnetic member 39L (39R) may preferably be about 3.0 mm or less. An effect similar to that in Embodiment 1 can also be achieved in the constitutions shown in FIGS. 15(*a*) and 15(*b*).

Embodiment 2

Figure 16:
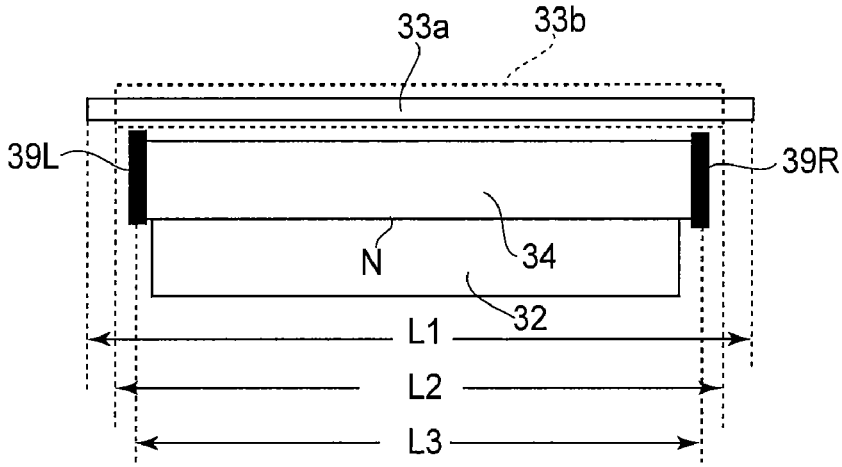
FIG. 16 is a schematic view showing a relationship among the longitudinal direction length of the coil, the longitudinal direction length of a coil core, and the longitudinal direction length of the belt in a fixing device in Embodiment 2.

In this embodiment, the image forming stations are similar to those in Embodiment 1. With reference to FIG. 16, a constitution of the fixing device in this embodiment will be described. The fixing device in this embodiment have the same constitution as that in Embodiment 1 except that the longitudinal direction length L2 of the coil core 33*b* is changed to 350 mm. That is, the longitudinal direction L1 of the coil 33*a* is 370 mm, the longitudinal direction length L2 of the coil core 33*b* is 350 mm, and the longitudinal direction length L3 of the belt 34 is 340 mm, i.e., L1>L2>L3. The belt 34 was rotated at the speed of 321 mm/s similarly as in Embodiment 1.

As Comparative Embodiment 3, in the fixing device in Embodiment 3, L1=370 mm, L2=330 mm, and L3=340 mm were set. That is, L1>L3>L2 is satisfied.

Figure 17:
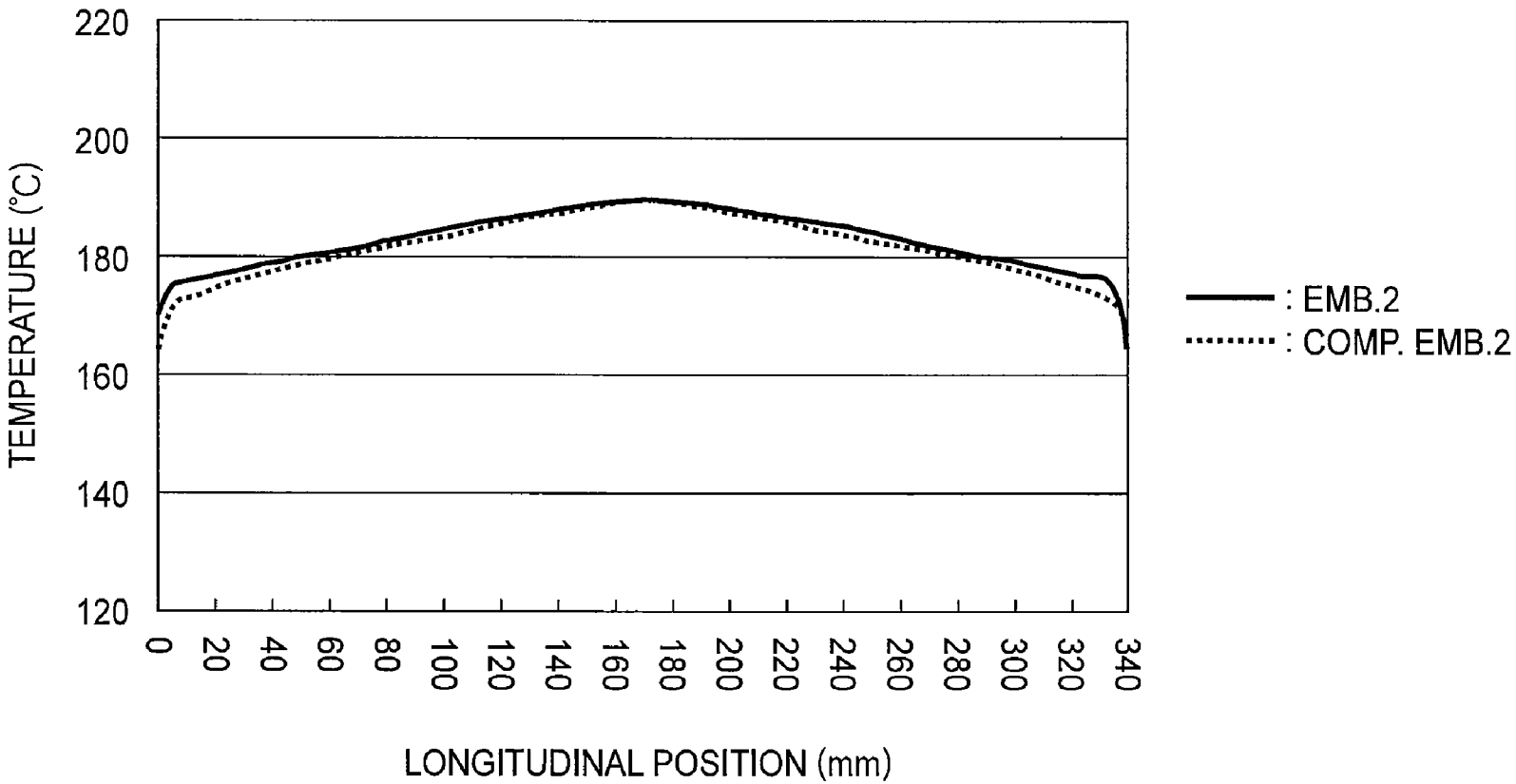
FIG. 17 is a graph showing a distribution of a temperature of the belt along the longitudinal direction of the belt in the case where a longitudinal central portion of the belt is heated from room temperature to 190° C. by driving fixing devices in Embodiment 2 and Comparative Embodiment 3.
Figure 18:
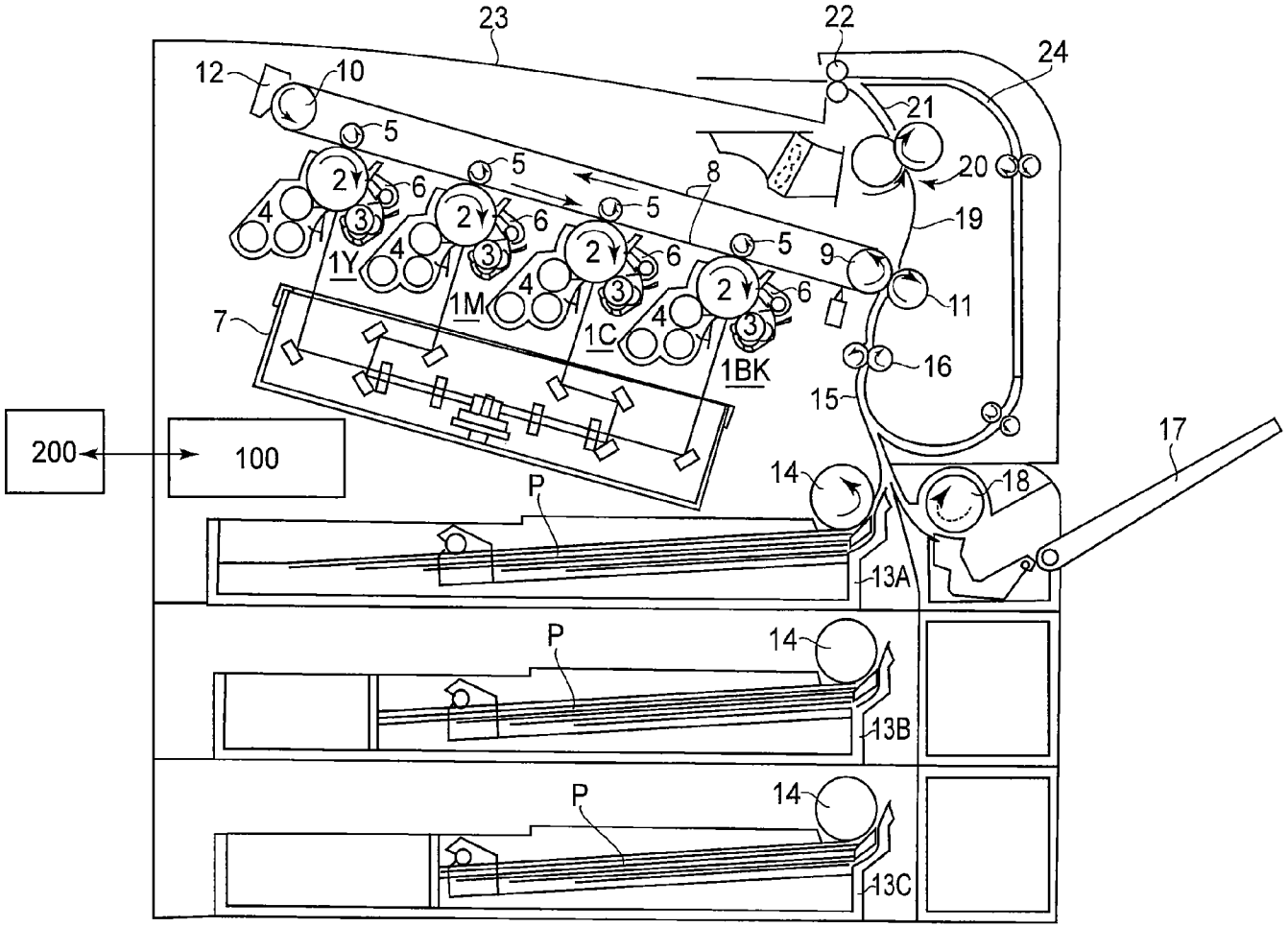
FIG. 18 is a schematic longitudinal sectional showing a schematic structure of an embodiment of an image forming apparatus.

Table 2 shows the constitutes of the fixing devices in Embodiment 2 and Comparative Embodiment 3. Further, a distribution of temperature with respect to the longitudinal direction of the belt 34 in the case where each of the fixing devices in Embodiment 2 and Comparative Embodiment 3 is driven to increase the temperature of the belt 34 at its longitudinal central portion to 190° C. is shown in FIG. 17.

TABLE 2

| | | Length (mm) | | | |
|---|---|---|---|---|---|
| EMB. | Relationship | L1 | L2 | L3 | Material |
| EMB. 2 | L1 > L2 > L3 | 370 | 350 | 340 | Ferrite |
| COMP. EMB. 2 | L1 > L3 > L2 | 370 | 330 | 340 | Ferrite |

Compared with Comparative Embodiment 3, in Embodiment 2, the longitudinal direction length of the coil core 33*b* is made longer than the belt 34, so that it is understood that the temperature at the belt end portions are kept at a higher level (closer to 190° C.).

Therefore, compared with the length relationship of L1>L3>L2 (Comparative Embodiment 3), it is found that the length relationship of L1>L2>L3 (Embodiment 2) is preferable in order to realize a uniform temperature distribution along the longitudinal direction of the belt 34. This may be attributable to a stronger magnetic field exerted on the belt 34 in Embodiment 2 compared with that in Comparative Embodiment 3.

Thus, the image heating apparatus of the electromagnetic induction heating type in which the magnetic field generating means 33 is provided outside the heat generating member 34 in Embodiment 2 is capable of suppressing excessive temperature rise at the end portions of the heat generating member 34 and the thermal deterioration of the heat generating member 34 while achieving energy saving.

In the above-described Embodiments 1 and 2, the belt member is used as the heat generating member 34 but a similar effect can also be obtained by using a thin film member as the heat generating member 34. Further, in the above-described embodiments, the magnetic member has the cylindrical shape but the similar effect can also be obtained even when the magnetic member does not have a complete cylindrical shape. Further, the similar effect can also be obtained by employing the magnetic member having a substantially cylindrical shape with a partly lacking portion.

The image heating apparatus of the present invention can be used as not only the image heating fixing apparatus as in the embodiments described above but also, e.g., the image heating apparatus for modifying a surface property such as glossiness or the like by heating the recording material on which the image is carried, the image heating apparatus for effecting temporary fixation, and the like.

As described hereinabove, according to the present invention, it is possible to reduce a degree of the temperature rise at the end portions of the heat generating member even when the coil length is longer than the length of the heat generating member.

While the invention has been described with reference to the structures disclosed herein, it is not confined to the details set forth and this application is intended to cover such modifications or changes as may come within the purpose of the improvements or the scope of the following claims.

This application claims priority from Japanese Patent Application No. 296462/2008 filed Nov. 20, 2008, which is hereby incorporated by reference.

What is claimed is:

1. An image heating apparatus comprising:

a coil for generating magnetic flux;

a rotatable heat generating member, having an electroconductive layer which generates heat by the magnetic flux, for heating an image on a recording material, wherein said coil has a length longer than that of said heat generating member with respect to a rotational axis direction of said heat generating member; and a magnetic member, provided oppositely to said coil at an end position of said heat generating member, having AC magnetic permeability of 1000 or more at 100 kHz.

2. An apparatus according to claim 1, wherein said magnetic member has a cylindrical shape.

3. An apparatus according to claim 1, wherein said magnetic member covers a side surface of an end portion of said heat generating member.

4. An apparatus according to claim 1, wherein said magnetic member is formed of a magnetic material at least containing ferrite or iron having the AC magnetic permeability of 1000 or more at 100 kHz.

5. An apparatus according to claim 1, wherein said coil includes a magnetic core, and wherein longitudinal direction lengths L1, L2 and L3 of said coil, said magnetic core and said heat generating member satisfy:

$$L1>L2>L3.$$

6. An apparatus according to claim 1, wherein said heat generating member comprises a flexible endless belt.

7. An apparatus according to claim 6, wherein said magnetic member presents lateral deviation of said endless belt with respect to a longitudinal direction of said endless belt.

* * * * *